United States Patent [19]

Schupphaus et al.

[11] 4,451,091

[45] May 29, 1984

[54] TRACK FOR A LONGWALL MINING MACHINE

[75] Inventors: Herbert Schupphaus, Bochum; Volker Knorr, Sprockhovel, both of Fed. Rep. of Germany

[73] Assignee: Gebr. Eickhoff Maschinenfabrik und Eisengiesserei m.b.H., Bochum, Fed. Rep. of Germany

[21] Appl. No.: 434,376

[22] Filed: Oct. 14, 1982

[30] Foreign Application Priority Data

Oct. 16, 1981 [DE] Fed. Rep. of Germany ..... 3141162

[51] Int. Cl.[3] ..... E21C 29/02

[52] U.S. Cl. ..... 299/43; 105/29 R

[58] Field of Search ..... 299/42, 43, 34; 74/422; 105/29 R; 1/9

[56] References Cited

U.S. PATENT DOCUMENTS

| | | | |
|---|---|---|---|
| 4,162,810 | 7/1979 | Oberste-Beulmann | 299/43 |
| 4,183,585 | 1/1980 | Brennan | 299/43 |
| 4,236,758 | 12/1980 | Groger | 105/29 R |
| 4,307,915 | 12/1981 | Knorr | 299/43 |
| 4,397,199 | 8/1983 | Jahn | 74/422 |

FOREIGN PATENT DOCUMENTS

| | | | |
|---|---|---|---|
| 2709153 | 9/1978 | Fed. Rep. of Germany | 299/43 |

*Primary Examiner*—William F. Pate, III
*Assistant Examiner*—Mark Del Signore
*Attorney, Agent, or Firm*—Thomas H. Murray

[57] ABSTRACT

A track and gear rack disposed on one side of a face conveyor for a longwall mining machine and adapted to be engaged by a driving gear and guide wheels on the mining machine, the track and gear rack being of generally L-shaped cross-sectional configuration and having a horizontal arm resting on the mine floor and a vertical arm secured to the face wall of the conveyor. Driving pin extensions extend outwardly from the vertical arm in cantilever beam relationship near the upper edge of the vertical arm and have vertical widths less than the height of the vertical arm. One of the arms of the L-shaped configuration is provided with studs which engage guide block means on the mining machine for guiding it along the track and gear rack. The invention facilitates good guidance of the mining machine along the track and gear rack without impeding the flow of mined material onto the face conveyor.

9 Claims, 4 Drawing Figures

TRACK FOR A LONGWALL MINING MACHINE

BACKGROUND OF THE INVENTION

The present invention relates to a track for a longwall mining machine, the track comprising discrete sections of L-shaped cross section, each of which preferably corresponds to the pan length of a face conveyor. The vertical arm of the track is secured to the face wall of the face conveyor such that it does not project above the height of the conveyor. Near the top longitudinal edge of this vertical arm are teeth or driving pin extensions which engage a driving gear on the mining machine. The driving pin extensions extend outwardly from the vertical arm of the track in cantilever beam relationship and have open ends facing the mineral face over a portion of the height of the vertical arm only. The lower horizontal arm projects below the driving pin extensions in the direction of advance of the mining machine and serves as a track for the wheels or rollers on the machine.

In U.S. Pat. No. 4,162,810, a toothed rack is shown comprised of discrete lengths disposed along the wall of a face conveyor adjacent the mineral face. The rack is of generally L-shaped cross section and is provided with horizontal rack pins which extend outwardly from the vertical arm of the track. The outer ends of the rack pins adjacent the mineral face are retained by a strip or lug extending over the length of the rack. The bottom arm of the L-shaped track configuration slopes downwardly as a ramp to the floor, projects over the aforesaid strip towards the face. To guide the machine laterally, the wheels engage a projection behind a vertical track arm which projects above the top edge of the face conveyor. It is also known in the prior art to provide the frame of a longwall mining machine on the side opposite the face with guide blocks around which a guide rail extends over the whole length of the machine path.

U.S. Pat. No. 4,307,915 discloses toothed racks for an underground mining machine wherein individual portions or sections of the rack are formed by a plate having a height substantially equal to that of the conveyor. Driving pin extensions (i.e., rack pins), which are barely wider than the machine driving gear engaging them, are open toward the mineral face and are disposed at equal intervals. Due to the fact that the driving pin connections in toothed racks of this type are supported in cantilever beam relationship and are open at their ends facing the face area, they do not hamper the flow of mined material to the face conveyor. However, they do require accurate horizontal guidance of the mining machine, something which is effected by means of a tubular guide rail disposed near the side of the conveyor opposite the face. Because of distortions caused by the pressure of the mining machine advancing cylinders, more particularly distortions of the bases of the conveying troughs, and lateral displacements of the machine body during sumping-in, the driving gear teeth may disengage from the rack teeth in curved zones of the face conveyor. This problem can be further heightened by the manufacturing tolerances of the side guide rail, and the conveyor and driving rack themselves. The overall result of these difficulties is that proper meshing of the drive gear with the rack is unreliable during negotiation of curves. These manufacturing tolerances, distortions of the conveyor produced by the advancing cylinders, and even horizontal displacements of the machine in the curved portions of the face conveyor can be nullified if the rack itself is provided with means for guiding the mining machine such as that disclosed in the aforesaid U.S. Pat. No. 4,162,810. Unfortunately, since the overall height of the guiding means is greater than that of the conveyor, and because of the presence of the strip at the forward ends of the driving pin projections, this feature hampers the lateral discharge of mined material to the face conveyor.

SUMMARY OF THE INVENTION

In accordance with the present invention, a track for a longwall mining machine is provided which will not exceed the overall height of the face conveyor and which provides accurate guidance of the machine horizontally without impeding the flow of mined material to the face conveyor.

Specifically, and in accordance with the invention, a track and gear rack is disposed on one side of a face conveyor for a longwall mining machine and is adapted to be engaged by a driving gear and guide wheels carried on the mining machine. The track and gear rack is of generally L-shaped cross-sectional configuration and is provided with a vertical arm secured to the face wall of the conveyor. Driving pin extensions (i.e., rack pins) extend outwardly from the vertical arm in cantilever beam relationship near the upper edge of the vertical arms and have a vertical width less than the height of the vertical arm. The L-shaped track and gear is also provided with a horizontal arm which extends beneath the driving pin extensions. Either the vertical arm or horizontal arm is provided with spaced studs which engage guide block means on the mining machine for guiding it along the track, the widths of the studs preferably being substantially equal to the widths of the driving pin extensions and lying in common planes of symmetry with at least some of the driving pin extensions.

With the construction of the invention, the ends of the driving pin extensions facing the mineral face being mined are not interconnected and are totally unimpeded. Likewise, the studs which engage the guide block means on the mining machine are spaced one from the other so that neither the driving pin extensions nor the studs impede the free movement of mined material onto the face conveyor.

The track of the invention provides accurate horizontal guidance of the mining machine and thus insures satisfactory meshing of its drive gear with the driving pin extensions. The driving pin extensions and studs are close enough together to obviate any impairment of guidance of the machine. As a result, the machine follows its track accurately even in the curved regions of the conveyor. At the same time, even if the width of the driving pin extensions scarcely exceeds the width of the mining machine drive gear, meshing is always adequate to transmit the forces needed to advance the machine.

The above and other objects and features of the invention will become apparent from the following detailed description taken in connection with the accompanying drawings which form a part of this specification, and in which.

Figure 1:
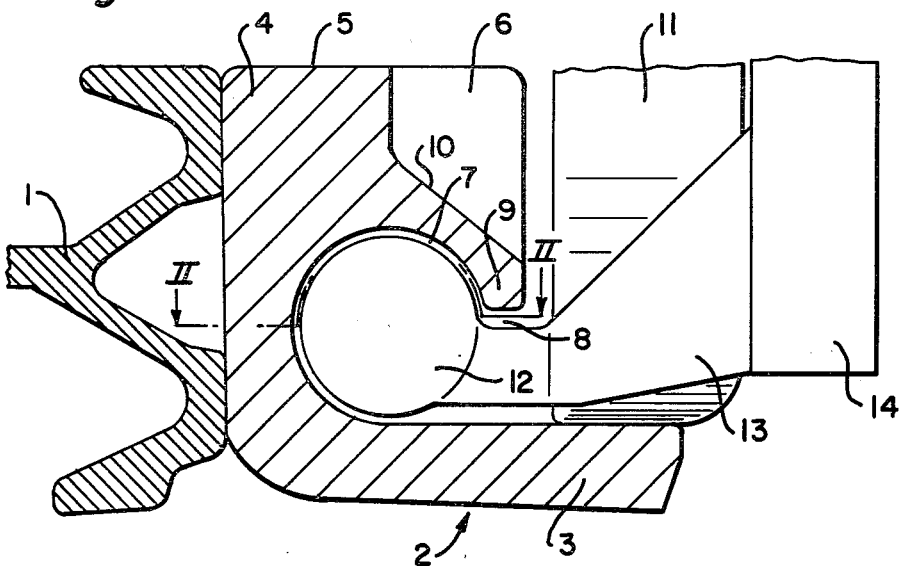
FIG. 1 is a cross-sectional view taken through one embodiment of the track and gear rack of the invention, the cross-sectional view being perpendicular to the length of the track and gear rack.
Figure 2:
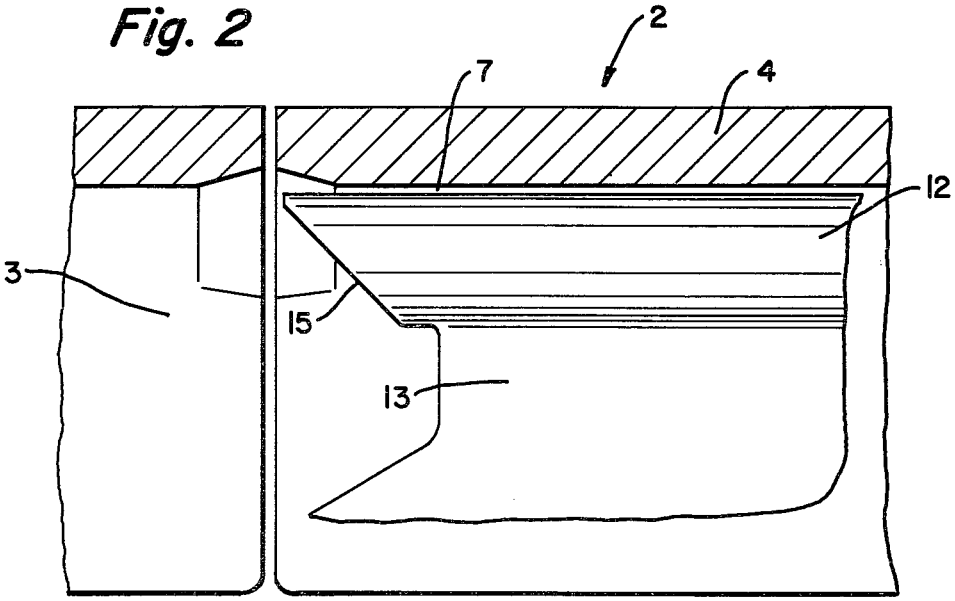
FIG. 2 is a cross-sectional view taken substantially along line II—II of FIG. 1.

With reference now to the drawings, and particularly to FIGS. 1 and 2, the overall track and gear rack of the invention is identified by the reference numeral 2 and is generally of the type shown and described in the aforesaid U.S. Pat. No. 4,307,915. The track and gear rack 2 is of generally L-shaped cross section and has a lower horizontal arm 3 and an integral vertical arm 4 which is secured to the side of a face conveyor 1. As shown, the top of the vertical arm 4 has a top surface 5 which is flush with the top of the face conveyor 1 and is provided with driving pin extensions 6 which extend outwardly from the arm 4 in cantilever beam relationship such that there is no connection between pins on the face side of the extensions. The extensions 6 are spaced along the track 2 (as shown generally in FIG. 3) and are each provided with a lower stud 9 preferably having a width substantially equal to the width of the extension 6. The studs 9 cooperate with the arms 3 and 4 to form a circular guide passage 7 from which a slot 8 extends toward the mineral face and away from the face conveyor 1. The height of the slot 8 corresponds substantially to the radius of the passage 7 and extends between the top surface of the lower horizontal arm 3 and the lower surfaces of the studs 9 disposed on the undersides of the extensions 6.

The width of each stud 9, as mentioned above, is preferably equal to the width of each driving pin extension 6. Alternatively, however, an integral stud can extend like a strip over the entire length of the track and gear rack section. In this latter case, the adjacent studs 9 will be interconnected and the resulting tooth base 10 will slope downwardly like a ramp towards the mineral face. The interconnected studs stiffen and reinforce the driving pins since they provide mutual and, therefore, additional bearing of the teeth in the root zone and thus enable the teeth to deal with very substantial advancing forces.

An overhead longwall mining machine, not shown, is provided with guide wheels or rollers 11 which bear on the portion of the horizontal arm 3 which extends beyond the driving pin extensions 6. Horizontal guidance for the mining machine is provided in the embodiment of FIGS. 1 and 2 by means of guide blocks 12 which can be conically-narrowing and which are received in the guide passages 7. The blocks 12 are rigidly secured, by means of arms 13 which extend through slots 8, to the frame 14 of the mining machine, not shown. As shown in FIG. 2, the guide blocks 12 are provided with end faces 15 which are inclined with respect to the direction of machine movement. The end faces 15 are preferably trough-shaped like ploughshares and serve to discharge outwardly through the slots 8 any dirt entering the guide passages 7. To improve the transition, the guide passage 7 preferably widens funnelwise at the ends of the various track and gear rack sections to prevent jamming of the blocks 12 as they move between adjacent portions of the track.

Figure 3:
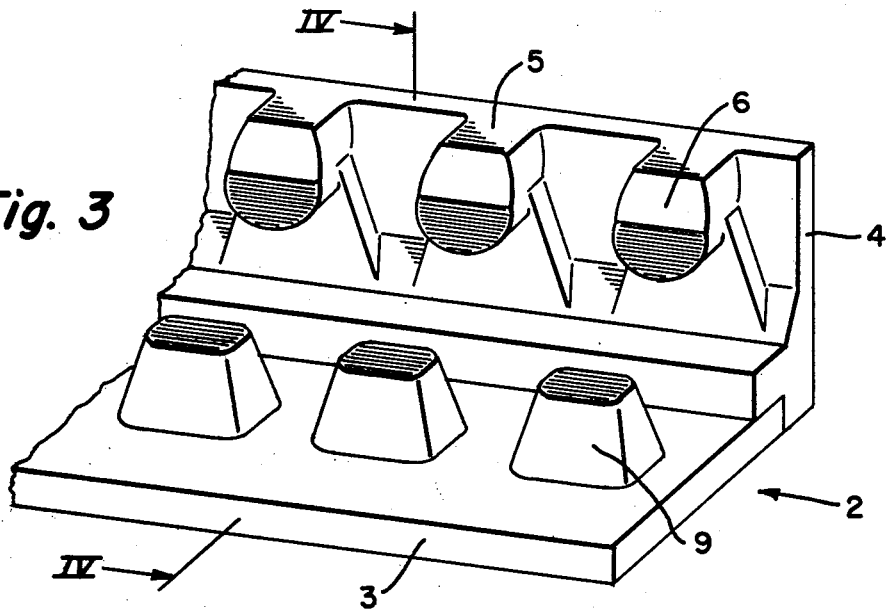
FIG. 3 is a perspective view of another embodiment of the invention.
Figure 4:
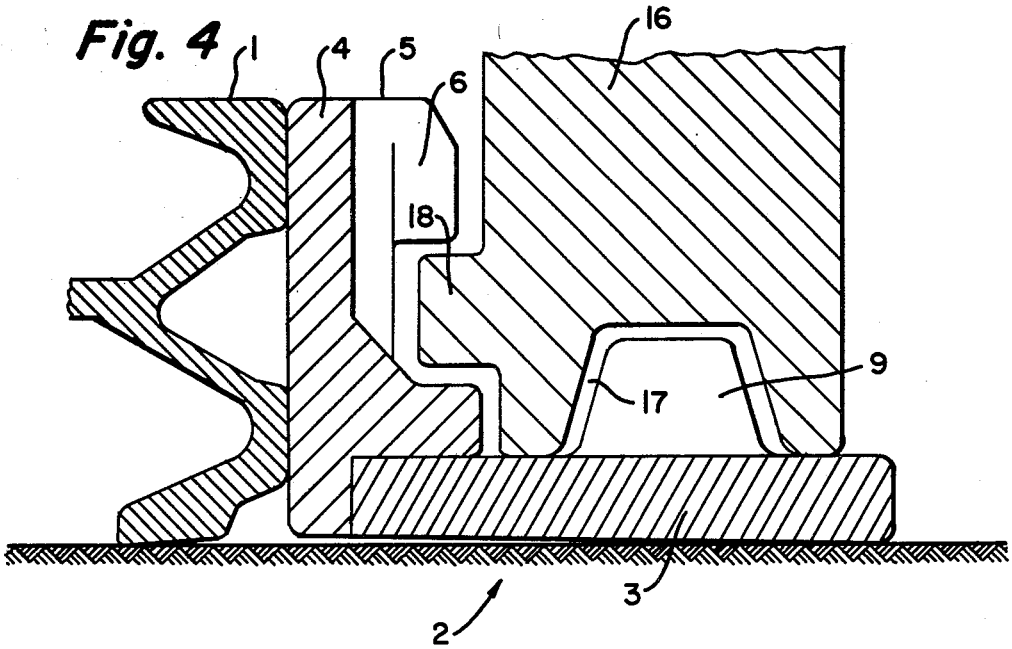
FIG. 4 is a cross-sectional view of the track and gear rack of FIG. 3, taken substantially along line IV—IV thereof, and incorporating the guide block means on a mining machine resting on the track.

In the embodiment shown in FIGS. 3 and 4, studs 9 are disposed on the horizontal arm 3 rather than the vertical arm 4. In this case, the studs 9 are disposed one before each driving pin extension 6 and each lies in a common plane of symmetry, with an associated stud, extending transversely to the length of the track. The studs 9 in this case can be spaced apart corresponding to an integral multiple of the spacing between the extensions 6. The studs can also be arranged in groups very near the junctions between portions of the track and rack to give added guidance in these areas. In the embodiment of FIGS. 3 and 4, the mining machine, not shown, is supported on guide runners 16 (FIG. 4) which slide on the horizontal arm 3. The runners 16 are provided with longitudinal grooves 17 which receive the studs 9 as the machine traverses the track to provide horizontal guidance. The sides of the runners 16 which are adjacent the face conveyor are provided with projections 18 beneath the driving pin extensions 6. These serve to maintain the runner 16 in the plane of the track (i.e., they guide the runners vertically). In both embodiments of the invention, the runners 16 and the guide blocks 12 are of a length greater than the spacing between the studs 9. This insures that there is a continuous and adequate positive engagement between the guide blocks or runners of the mining machine and the studs or stud groups of the track.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A track and gear rack disposed on one side of a face conveyor for a longwall mining machine and adapted to be engaged by a driving gear and guide means on the mining machine, said track and gear rack being of generally L-shaped cross-sectional configuration and having a vertical arm secured to the face wall of the conveyor, driving pin extensions extending outwardly from said vertical arm in cantilever beam relationship near the upper edge of said vertical arm and having vertical widths less than the height of the vertical arm, said L-shaped track and gear rack having a horizontal arm extending beneath said driving pin extensions, one of said arms being provided with spaced studs which engage guide block means on the mining machine for guiding it along said track, said studs lying in common planes of symmetry with at least some of said driving pin extensions, and said common planes extending transverse to the longitudinal length of said track and gear rack.

2. The track and gear rack of claim 1 wherein the widths of said studs are subsstantially equal to the widths of said driving pin extensions.

3. The track and gear rack of claim 1 wherein said studs extend downwardly from said driving pin extensions toward said horizontal arm, circular guide passages bounded by said vertical arm, said horizontal arm and said studs, slots between the top of said horizontal arm and the bottoms of said studs, guide blocks slideable in said guide passages, and arm means adapted to extend through said slots for connecting said guide blocks to the mining machine.

4. The track and gear rack of claim 3 wherein said slot has a height corresponding substantially to the radii of the guide passages.

5. The track and gear rack of claim 1 wherein said studs are interconnected between successive driving pin extensions and form a tooth base which slopes downwardly toward said horizontal arm, whereby a continuous guide passage extends along said track and gear rack.

6. The track and gear rack of claim 5 wherein the track and gear rack is formed in sections, and wherein the guide passage widens funnelwise near the connection of one section to the other.

7. The track and gear rack of claim 3 wherein said guide blocks have end faces which are inclined with respect to the longitudinal axes of the guide blocks and are trough-shaped to discharge mined material entering the guide passages through said slots.

8. The track and gear rack of claim 1 wherein said studs project upwardly from said horizontal arm, and wherein machine runners slide on said horizontal arm, the runners having longitudinal gooves which pass over said studs.

9. The track and gear rack of claim 8 including projections on said runners which pass beneath said driving pin extensions on said vertical arm to limit vertical movement of the mining machine with respect to said track and gear rack.

* * * * *